US005375741A

United States Patent [19]

Harris

[11] Patent Number: 5,375,741

[45] Date of Patent: Dec. 27, 1994

[54] CONTAINER FOR BULK MATERIAL AND ITS METHOD OF MANUFACTURE

[75] Inventor: Jack E. Harris, Savannah, Ga.

[73] Assignee: Encon, Inc., Romeo, Mich.

[21] Appl. No.: 60,267

[22] Filed: May 12, 1993

[51] Int. Cl.[5] ..... B65D 35/56

[52] U.S. Cl. ..... 222/105; 222/143; 222/185

[58] Field of Search ..... 222/94, 105, 183, 185, 222/143; 220/462, 403, 254; 108/55.3; 206/503; 383/22

[56] References Cited

U.S. PATENT DOCUMENTS

| | | | |
|---|---|---|---|
| D. 332,130 | 12/1992 | Przytulla | D23/202 |
| 2,887,251 | 5/1959 | Mackridge | 222/131 |
| 3,785,534 | 1/1974 | Smith | 222/143 X |
| 4,157,609 | 6/1979 | Schütz | 29/428 |
| 4,158,425 | 6/1979 | Sansbury | 220/461 |
| 4,173,288 | 11/1979 | Schutz | 220/1.5 |
| 4,373,928 | 2/1983 | Horton | 493/103 |
| 4,398,653 | 8/1983 | Daloisio | 222/143 X |
| 4,426,015 | 1/1984 | Preston et al. | 220/403 |
| 4,516,692 | 5/1985 | Croley | 222/105 |
| 4,690,299 | 9/1987 | Cannon | 220/402 |
| 4,717,374 | 1/1988 | Elias | 493/292 |
| 4,760,949 | 8/1988 | Elias | 229/4.5 |
| 4,767,021 | 8/1988 | Pies | 220/465 |
| 4,793,519 | 12/1988 | Voorhies, Jr. | 220/465 |
| 4,930,661 | 6/1990 | Voorhies | 220/465 |
| 4,949,872 | 8/1990 | Heaps, Jr. | 222/143 X |
| 4,995,588 | 2/1991 | Nichols | 251/144 |
| 5,029,734 | 7/1991 | Nichols | 222/105 |
| 5,059,634 | 10/1991 | Smith | 521/167 |
| 5,064,096 | 11/1991 | Illing et al. | 222/105 |
| 5,110,000 | 5/1992 | Nichols | 220/4.16 |
| 5,111,937 | 5/1992 | Schutz | 206/386 |
| 5,133,476 | 7/1992 | Schutz | 220/622 |
| 5,156,268 | 10/1992 | Nichols | 206/386 |

FOREIGN PATENT DOCUMENTS 9221575 12/1992 WIPO .

OTHER PUBLICATIONS

"Introducing TUFF TANK.", Chemical Handling Equipment Co., Inc., 5451 Enterprise Blvd., Toledo, Ohio 43612; 2 pages; 1987.

"PDCPD: a new structural resin poised for the '80s"; Plastics Engineering; 4 pages; 1985.

"Atlas 360" and Saturn 350; Georgia Polymer Inc., P.O. Box 161554, Atlanta, Georgia 30321; 4 pages; date unknown.

(List continued on next page.)

*Primary Examiner*—Gregory L. Huson

*Attorney, Agent, or Firm*—Renner, Kenner, Greive, Bobak, Taylor & Weber

[57] ABSTRACT

A container (10) for carrying bulk materials includes a body portion (12) having an open top, a cover (11) to close the open top, and a base portion (13) holding the body portion. The base portion (13) has sidewalls (39) which cradle the sidewalls (25) of the body portion (12), which sidewalls (25) are tapered so that the container (10) can be nested within a like container. Material to be discharged from the container may pass through a valve (33) positioned in a recess (32) in a sidewall (25) of the base portion (12). A preferably flexible liner (14) may be received in body portion (12) and includes a peripheral cuff (46) for attachment to the cover (11) and base portion (12). The liner (14) also has a tube (44) which can communicate with the valve (33) for discharge of the material from the liner (14). The container (10) is made of a resulting translucent plastic formed from the reaction of an isocyanate and a polyol resin utilizing a process whereby pressure is applied to the tanks (58, 60) holding the reactant material (58) and the resin material (60) only during the time when the materials (58, 60) are being transported to the mold (67).

31 Claims, 6 Drawing Sheets

OTHER PUBLICATIONS

"The METTON System—A Breakthrough in Structural Plastics", AIChE Symposium Series, New Polymer Technology for Auto Body Exteriors; 5 pages; date unknown.

1 page from "HAZMAT WORLD"; 1991.

1 page; Consolidated Plastics, Twinsburg, Ohio 44087; date unknown.

ENPAC Corporation, 8400 Baymeadows Way, Bldg. 18, Jacksonville, Florida 32256; 1 page; 1991.

"The Uni-Pak Bulk System"; Shuert Industries Sales Inc., 6600 Dobry Road, Sterling Heights, Mich. 48314; 6 pages; date unknown.

21st Century Containers, Ltd., 150 Selig Drive, Atlanta, Georgia 30336; 5 pages; 1992.

"CONCERTAINER"; Van Leer Nederland B.V., Fibre Drums & Plastic Containers, Keulsekade 216, 3534 AC Utrecht; 4 pages; date unknown.

"The SONOBULK System"; Sonoco IBC, 100 Alex Street, Lavonia, Ga. 30553; 8 pages; date unknown.

Bonar Plastics Inc., 1005 Atlantic Drive, West Chicago, Illinois 60185; 39 pages; date unknown.

"Duratank", Hoover Group Incorporated, Alpharetta, Georgia 30201; 26 pages; 1991.

CONTAINER FOR BULK MATERIAL AND ITS METHOD OF MANUFACTURE

TECHNICAL FIELD

This invention generally relates to a container of a type which is particularly adapted to carry bulk liquid or solid materials. More specifically, this invention relates to a plastic container which is nestable with like containers and which can be provided with a plastic liner. More particularly, the plastic container is made to be translucent through a unique manufacturing process such that the user can visually determine the quantity of material being stored in the container.

BACKGROUND ART

The transportation of large quantities of bulk liquids or solid materials is usually accomplished by tanker trucks or the like, whereas traditionally, smaller quantities thereof are shipped or transported in the conventional 55-gallon drum. While such drums have for years been the benchmark for small quantity bulk material containers, such are not without their problems. Such is particularly the case where intermediate quantities of material, that is, more than 55 gallons and less than a tanker truck quantity, are desired.

In addition to their weight and the tendency to leak, dent, and corrode, one of the primary concerns regarding the 55-gallon drum relates to the costs of handling, using, and disposing of the same. For example, if in excess of 300 gallons of bulk material is desired, six 55-gallon drums must be separately filled, shipped, and then handled by the user. Dispensing of the material is not easy in that the container must be tipped and/or inverted to do so. Upon emptying, such drums must then be cleaned for re-use and often, upon opening a drum believed to be empty, the user finds a small quantity of remaining material therein which not only becomes wasted but which also compounds the cleaning problem. Then the drums must usually be shipped for refilling, and since they take up as much space empty as filled, and since their cylindrical configuration wastes space when positioned side-by-side, return shipping costs are amplified. Finally, the life of such drums is such that disposal is usually required after no more than four uses thereby loading up land fills with remnants of possibly hazardous material thereby incurring the potential of long-term open-ended liability.

In an effort to solve at least some of these problems, recently some bulk containers have been introduced which have become known in the trade as intermediate bulk containers because they are capable of holding more material than a 55-gallon drum, but much less than a tanker truck. Typical of such containers is the type which includes a blow-molded plastic bottle-like tank which is received within a heavy metal cage or multi-walled corrugated box for structural support. While being capable of providing more volume than the 55-gallon drum, such containers are still heavy and difficult to clean. Moreover, there is no way for the user to be certain that the contents thereof have been completely depleted and as in the case of the 55-gallon drum, quite often when the container is opened, some remaining material is found therein. In addition, most of these containers are not designed for long term reuse and must be discarded after just a few uses. For those which may be refilled and reused several times, the empty shipping thereof for refilling remains a costly endeavor.

Thus, the need exists for a bulk container, particularly one of an intermediate size being capable of holding the quantity of several 55-gallon drums, which is relatively light weight and free from denting, and the corrosion and leakage problems. Moreover, the need exists for such a container which is easy to handle, fill, and clean, and one in which the user can determine the quantity of material remaining therein. Finally, the need exists for a container which will drain completely and be economically reused because it can be conveniently shipped when empty.

DISCLOSURE OF THE INVENTION

It is thus an object of the present invention to provide a reusable bulk container of an intermediate size, being capable of holding a quantity of material of several 55-gallon drums.

It is another object of the present invention to provide a container, as above, which is easy to fill, easy to clean, and easy to handle, a conventional fork lift truck being able to carry the container with access from any side thereof.

It is a further object of the present invention to provide a container, as above, which is made of a translucent plastic material by a unique manufacturing process so that the user can readily determine the quantity of material remaining therein.

It is yet another object of the present invention to provide a container, as above, from which its contents can be completely discharged through a bottom valve which is positioned in a recess in the container and thereby protected from damage or accidental opening.

It is an additional object of the present invention to provide a container, as above, which may receive, and hold in place, a plastic liner which is easy to install and easily connectable to the drain valve.

It is still another object of the present invention to provide a container, as above, which can be stacked upon a like container, when full or empty, and which may be nested within a like container, with the liner still within the container, all for convenient shipment or storage purposes.

It is a still further object of the present invention to provide a container, as above, which has no tendency to leak, dent or corrode and which is light weight considering the volume of material which it can carry.

These and other objects of the present invention, as well as the advantages thereof over existing prior art forms, which will become apparent from the description to follow, are accomplished by the improvements hereinafter described and claimed.

In general, a container for holding material made in accordance with the concepts of the present invention includes a generally rectangular body portion having a bottom surface and sidewalls extending upwardly therefrom to form an upper lip defining an open top through which the materials may be received by the body portion. A cover can be attached to the body portion to close the open top. A base portion includes a plurality of feet, a surface to support the body portion and sidewalls which extend upwardly to cradle the lower end of the sidewalls of the body portion.

In accordance with another aspect of the present invention, a plastic liner for the body portion may be provided and includes a bottom surface and a sidewall extending upwardly therefrom which is capable of conforming to the sidewalls of the body portion. A cuff positioned near the top of the liner is adapted to be positioned between the upper lip of the body portion and the cover for attachment therebetween. The liner may also have a top surface with an opening through which the material may pass.

A concept of the present invention also permits the container to be nested within a like container. To that end the sidewalls of the body portion taper outwardly as they extend upwardly from the bottom surface so that the profile of the upper lip is larger than that of the bottom surface. Nesting is accomplished even though a material discharge valve is attached to the body portion because the valve is positioned in a recess near the bottom of one of the sidewalls thereof.

At least the body portion of the container can be made of a translucent plastic by reacting an isocyanate with a polyol resin utilizing a process whereby a supply of the resin is held in one tank and a supply of the reactant is held in another tank. A quantity of the resin and a quantity of the reactant are periodically transported to a mold and the supply of the resin and the supply of the reactant are pressurized only during the time the resin and reactant are being transported to the mold. Thereafter, the body portion is formed and the resulting translucent product is removed from the mold.

A preferred exemplary embodiment of a container, and its method of manufacture, incorporating the concepts of the present invention, are shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
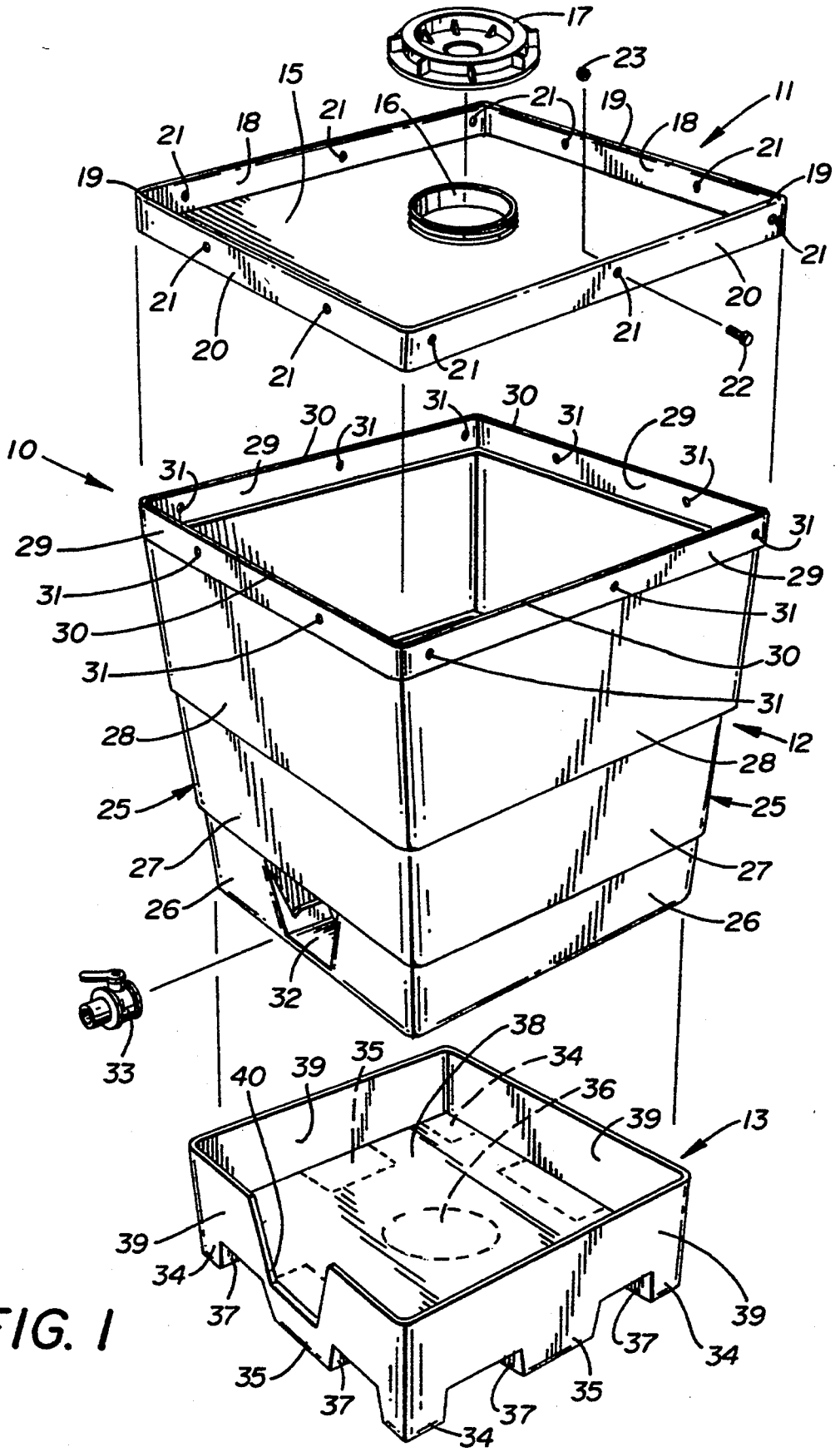
FIG. 1 is an exploded perspective view showing the various individual components which make up a container made in accordance with the concepts of the present invention.
Figure 2:
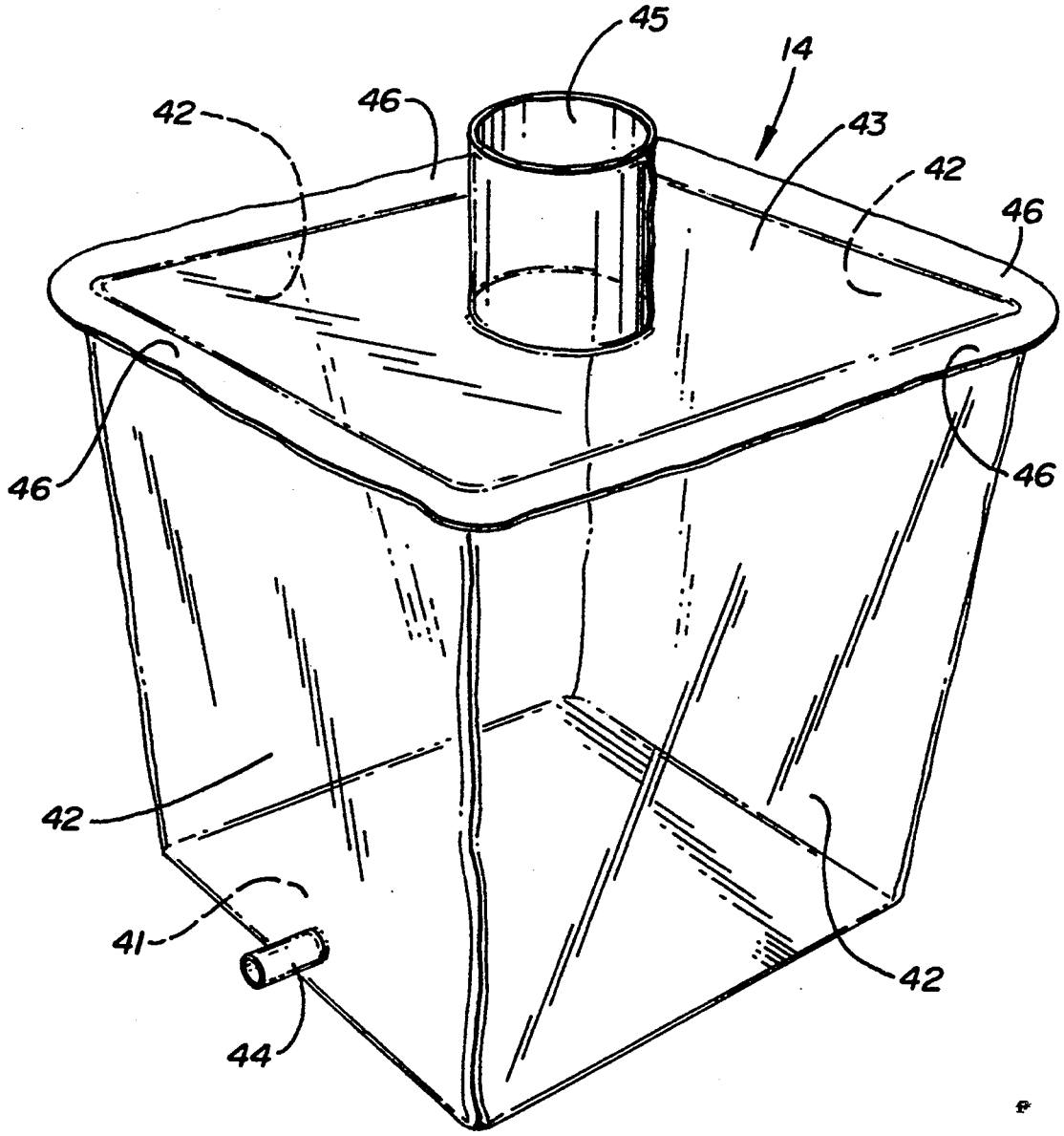
FIG. 2 is a perspective view of a plastic liner which may be utilized with the container of FIG. 1.

A container made in accordance with the concepts of the present invention is generally indicated by the numeral 10 in the drawings and includes, as its major components, a cover generally indicated by the numeral 11, a container body generally indicated by the numeral 12, a base or pallet portion generally indicated by the numeral 13, and an optional liner generally indicated by the numeral 14 and shown in FIG. 2.

Figure 4:
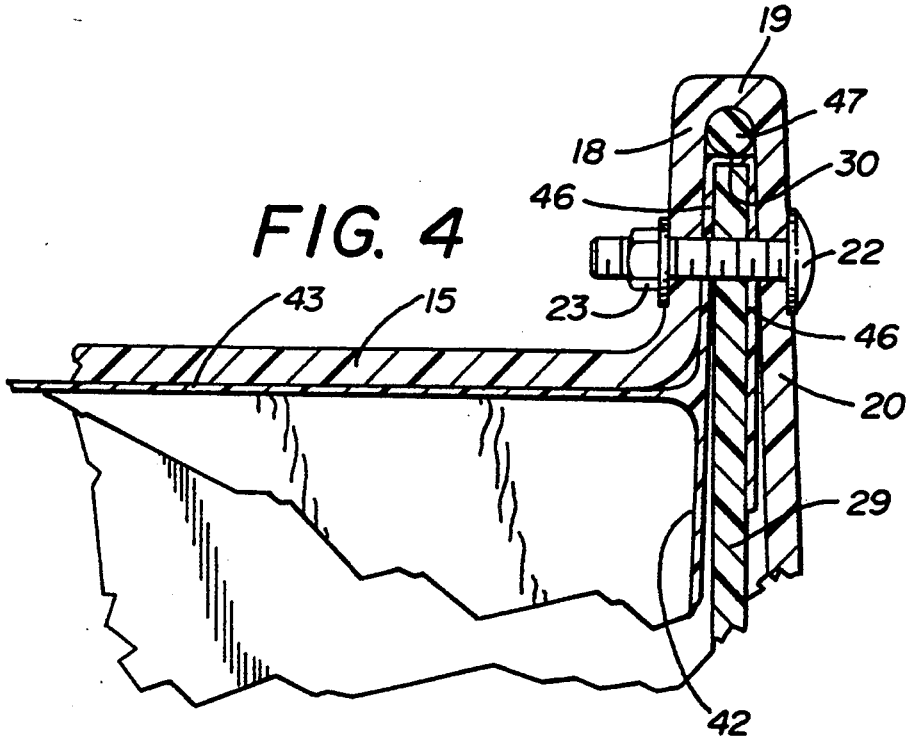
FIG. 4 is a fragmented sectional view taken substantially along line 4—4 of FIG. 3.

Cover 11 includes a generally planar surface 15 having a central threaded neck opening 16 formed therein through which liquid or solid material may pass to fill container 10. A conventional threaded cap 17 may also be received by neck 16 and is adapted to receive a nozzle so that liquid material may be optionally received into container 10 through cap 17. As best shown in FIG. 4, the periphery of surface 15 is provided with upturned walls 18 having an upper rim 19 extending outwardly therefrom. An outer skirt 20, spaced from wall 18, extends downwardly from upper rim 19. A plurality of apertures 21 extend through walls 18 and skirts 20 on all sides of cover 11 to receive fasteners 22 therethrough. Fasteners 22 can be in the form of bolts held in place by nuts 23 so that, in a manner to be hereinafter described, cover 11 is not only attached to container body 12 but also liner 14 can be attached between cover 11 and body 12.

Container body 12 is generally rectangular in configuration and includes a bottom surface 24 (FIGS. 5 and 6) and four sidewalls generally indicated by the numeral 25. Sidewalls 25 preferably taper outwardly as they extend upwardly from bottom surface 24 for molding and nesting purposes as will hereinafter be described. Although not critical to the present invention, primarily for strength and aesthetic purposes, each sidewall 25 includes three stepped surfaces, the lowermost surface 26 extending upwardly from bottom surface 24, an intermediate surface 27 stepped outwardly from surface 26, and an uppermost surface 28 stepped outwardly from surface 27. The top of uppermost surface 28 is provided with an upper rim 29, stepped slightly outwardly therefrom and having an upper rectangular lip 30 defining an open top for container body 12. Rim 29 includes a plurality of apertures 31 extending therethrough to be aligned with apertures 21 of cover 11 to receive fasteners 22. Lowermost surface 26 of one sidewall 25 is provided with a recess or well 32 into which is received, in a manner to be hereinafter described, a conventional ball valve 33 for the discharge of liquid material from container 10. By providing recess 32 for valve 33, it is fully protected from damage and accidental opening.

Figure 3:
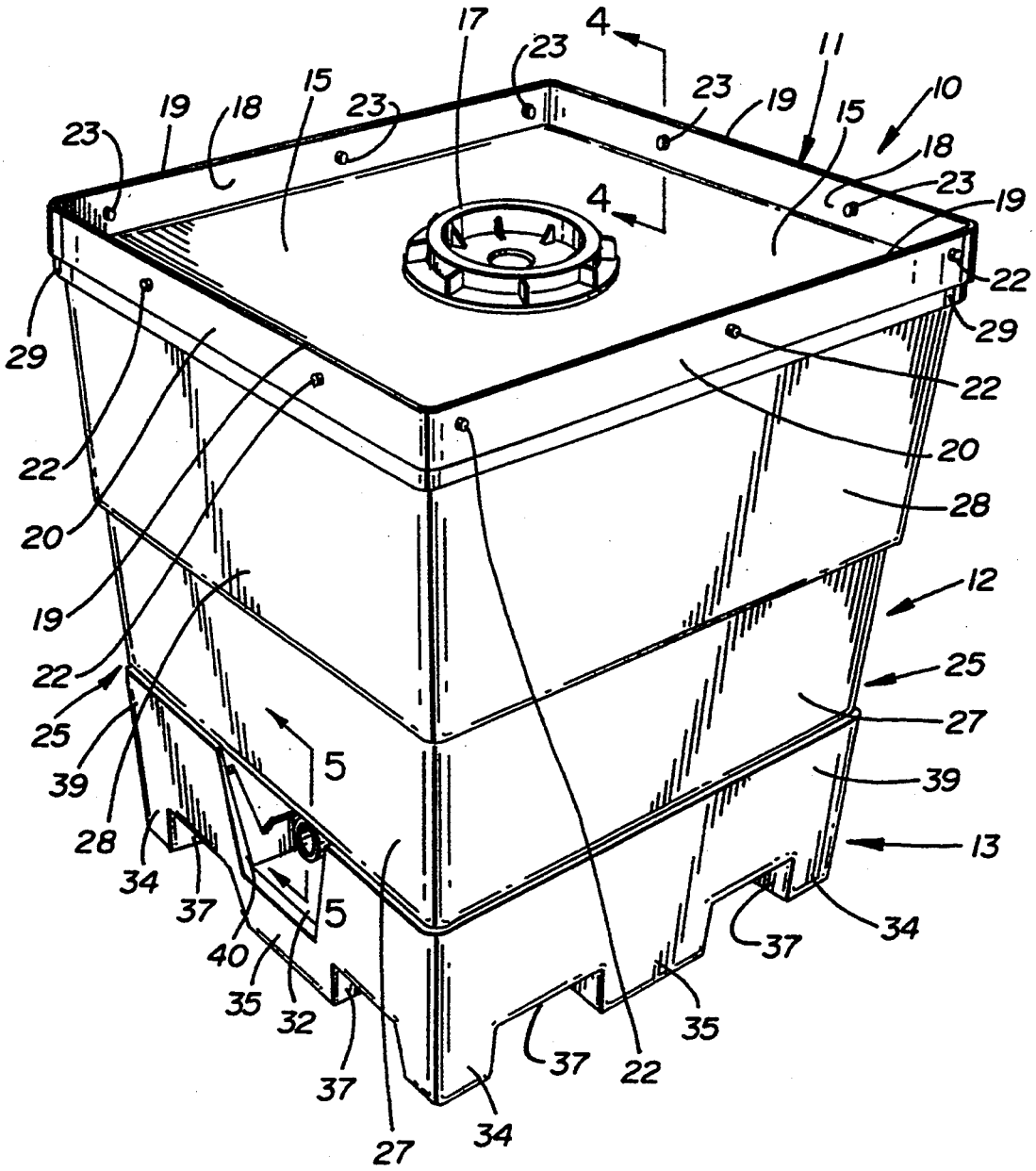
FIG. 3 is a perspective view of an assembled container made in accordance with the concepts of the present invention.
Figure 6:
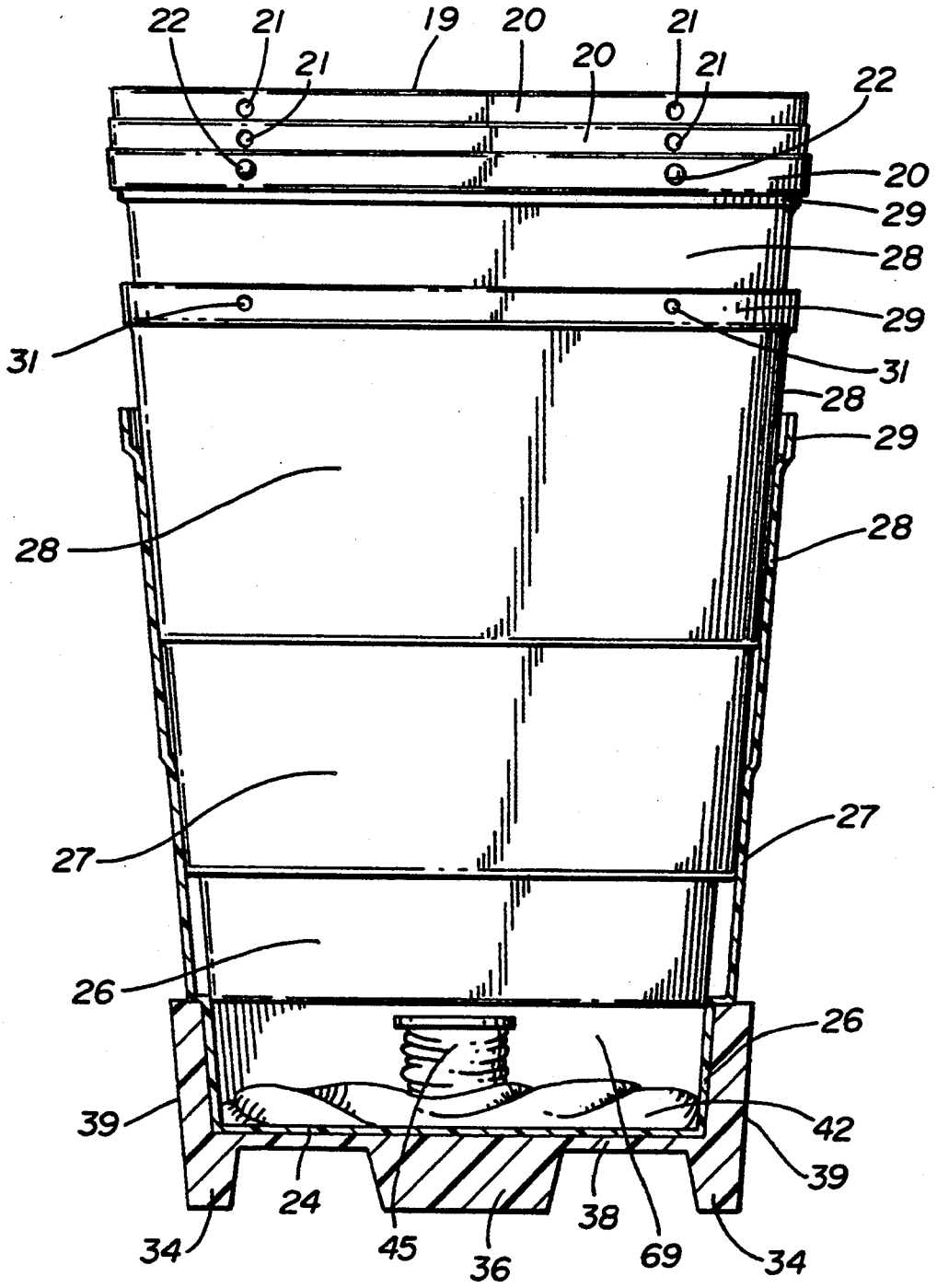
FIG. 6 is a view showing a container made in accordance with the concepts of the present invention in section and showing other like containers nested therein with lids stacked thereon.

Base pallet portion 13 of container 10 can have a foam core to absorb the shocks of handling and includes corner feet 34, central side feet 35 and a center foot 36 between opposed pairs of central side feet 35. As shown, central side feet 35 are spaced from their adjacent corner feet 34 forming recesses 37 which extend laterally across and underneath base pallet portion 13 in both directions. Each pair of adjacent recesses are suitably sized and positioned to receive the arms of a forklift truck so that container 10 can be lifted when approached from any direction. Base pallet portion 13 is also provided with a support surface 38 at a level above recesses 37. Sidewalls 39 extend upwardly from support surface 38, feet 34, 35, and recesses 37. Sidewalls 39 taper outwardly as they extend upwardly, are of a configuration generally corresponding to the taper and height of the lowermost wall surface 26 of container body 12, and form an open top for base pallet portion 13. In addition, the inner dimension of sidewalls 39 approximates the outer dimension of surface 26 so that when container body 12 is placed on base pallet portion 13, with bottom surface 24 of container body 12 resting on support surface 38 of base pallet portion 13, sidewalls 39 act as a support skirt or cradle for surface 26 and body 12, as best shown in FIGS. 3 and 6. One sidewall 39 is provided with a trapezoidal notch 40 above its side foot 35 to be aligned with valve recess 32 of body 12 when container 10 is assembled.

When container 10 is assembled, as shown in FIG. 3, that is, when body portion 12 is placed on base pallet portion 13 and when cover 11 is attached to body portion 12, as previously described, container 10 may receive bulk material directly therein. As such, when the material is depleted therefrom, cover 11 may be removed and container 10 easily cleaned, as would be necessary particularly if it were to be filled again with a different material. On the other hand, liner 14, now to be described, may be positioned in container 10 thereby eliminating the need for such cleaning.

Liner 14 is shown in FIG. 2 and may be constructed of a sturdy, translucent material such as polyvinylchloride, polypropylene or the like. While liner 14 is preferably bag-like and flexible, it could be constructed in a more rigid condition to take on the form shown in FIG. 2; however, even when made flexible, liner 14 will take on the general configuration of that shown in FIG. 2 when positioned in container 10. In its stretched form, liner 14 is thus cubical in nature, taking on the form of body portion 12, thus having a bottom surface 41, four sidewalls 42, and a top wall 43. Seams may be provided, as desired, at the various junctions of sidewalls 42, bottom surface 41 and sidewalls 42, and top wall 43 and sidewalls 42. Even if liner 14 is formed of flexible polypropylene, bottom surface 41 is preferably made rigid by having a fiberboard or other material attached thereto or integrally formed therewith. A tube 44 is formed near the bottom of one of sidewalls 42 so that the material to be placed in liner 14 may communicate with valve 33 for discharge therethrough in a manner to be hereinafter described. Top wall 43 is provided with a central opening defined by a neck 45 which can be aligned with neck opening 16 in cover 11 so that material may pass therethrough and into liner 14 during the filling thereof. Neck 45 can be twisted and tied in a conventional fashion should it be desirable to close the top of a liner 14 full of material.

A flexible cuff 46 is provided at the top of liner 14 extending generally parallel to and outwardly from top wall 43 around the entire periphery thereof. Cuff 46 is utilized to attach liner 14 to the upper end of container 10 as shown in FIG. 4. Liner 14 is first positioned in container body portion 12 by pushing rigid bottom surface 41 downwardly flush against bottom surface 24 of body portion 12, bottom surfaces 41 and 24 being of the same profile. At this time, the liner must be positioned so that the sidewall 42 having liner tube 44 is aligned with recess 32 of container body portion 12, and the liner 14 may then be attached to valve 33 in a manner to be hereinafter described. The sides 42 of liner 14 can then be draped along walls 25 and cuff 46 is stretched over and around upper lip 30 of container body 12, and downwardly along the outside of rim 29, as shown in FIG. 4. Such maintains liner 14 upright within body portion 12 and renders top wall 43 of liner 14 taut, as shown in FIG. 2. Cover 11 is then positioned so that the container body rim 29, with liner cuff 46 positioned thereon, is between its upturned walls 18 and outer skirt 20, and fasteners 22 are then applied, as previously described. Holes may either be manually punched in, or preformed in, cuff 46 to receive fasteners 22 therethrough. Whether a liner 14 is employed or not, an o-ring gasket 47 may be positioned under rim 19 of cover 11, between walls 18 and skirt 20, to provide a seal between cover 11 and body portion 12.

Figure 5:
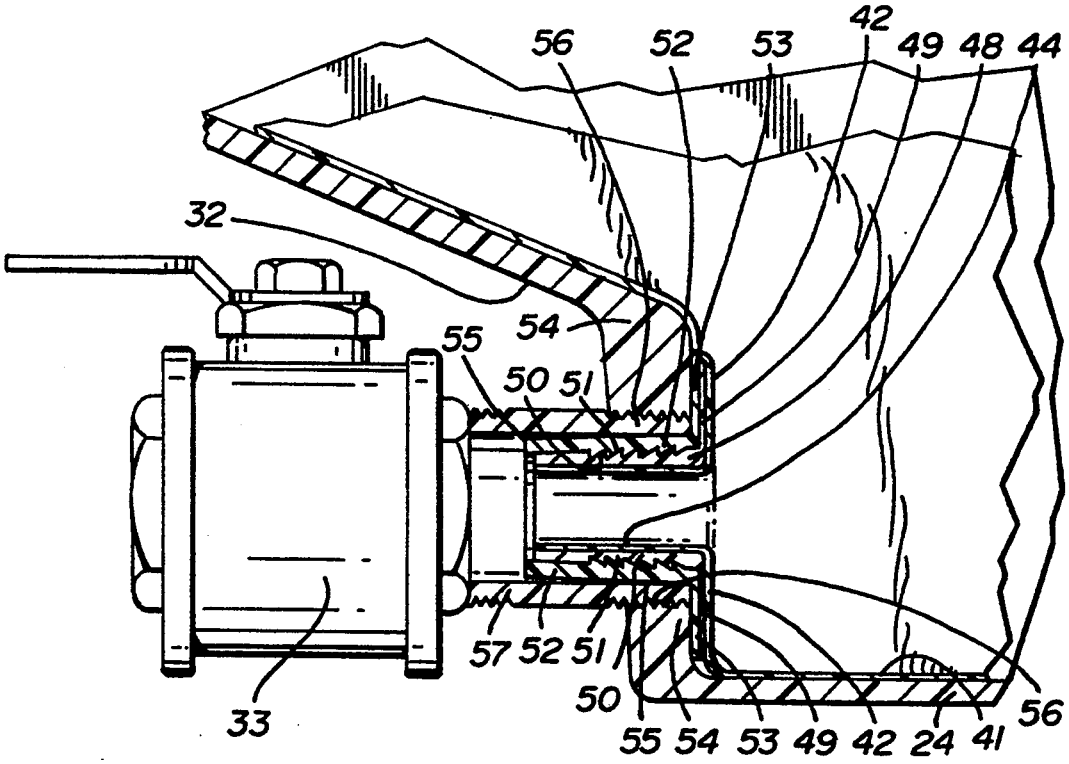
FIG. 5 is a fragmented sectional view taken substantially along line 5—5 of FIG. 3.

The manner in which liner 14 communicates with valve 33 is shown in FIG. 5. A semirigid tubular connector element 48 (not shown in FIG. 2) receives tube 44 of liner 14 axially therein and includes a flange 49 which may be heat sealed to a sidewall 42 of liner 14. Connector element 48 is also provided with circumferential external lock barbs 50 which engage like, but opposed, lock barbs 51 formed on the inside of a flexible adaptor tube 52. Adaptor tube 52 includes a flange 53 which is positioned between flange 49 of connector element 48 and wall 54 of recess 32 in container body 12. Adaptor tube 52 has a tapered outer surface 55 and is received through an aperture 56 formed in wall 54. A valve nipple 57 is threaded on both ends thereof to be attached to valve 33 and to aperture 56 of wall 54. Nipple 57 frictionally engages the outer axial end of tapered outer surface 55 of adaptor tube 52.

Thus, to permit the material inside of liner 14 to communicate with valve 33, all that need be done is to push adaptor tube 52, as carried by connector element 48 which in turn carries tube 44 of liner 14, into nipple 57. Then, liner 14 may be attached between cover 11 and body portion 12 as previously described. If liner 14 is not utilized, then valve 33 can merely directly communicate with the contents of body portion 12 through nipple 57. Because tube 44 is positioned in liner 14 very close to the bottom thereof, essentially complete discharge of the material therein through valve 33 can be accomplished. If desired, bottom surface 24 of container body portion 12 can be sloped toward the discharge area to even more readily assure a complete discharge. If container 10 is carrying solid, granular material, a vacuum source can be applied at the discharge area to remove the material from container 10 or, of course, the material may be removed from the top of container 10 either by removing cover 11 or directly through neck opening 16 therein.

Whatever material is being maintained in container 10, it is a benefit to the user to be able to determine the quantity of the contents of the material remaining therein. To that end, by use of special plastic materials and a unique manufacturing process, at least container body portion 12 of container 10 can be made translucent. Thus, container 10 is preferably made of a thermosetting, translucent polymeric material which is the reaction product of at least two reactive components. More preferably, the translucent material is a polyurethane, polyurea, polyisocyanurate or hybrids thereof, which are formed by the reaction of an isocyanate and a resin, in a process to be further described hereinbelow. By "translucent polymeric material" it is understood that the material is translucent when set and may or may not be translucent before setting, such as during the injection process or the like.

Useful isocyanates include organic isocyanates and polymeric derivatives thereof useful in making polyurethanes, polyureas and polyisocyanurates, such as, aromatic, aliphatic and cycloaliphatic polyisocyanates. Exemplary compounds include toluene diisocyanate, diphenylmethane diisocyanate, polymeric diphenylmethane diisocyanate and mixtures thereof.

A crude polyisocyanate may also be used in the practice of this invention, such as, the crude toluene diisocyanate obtained by the phosgenation of a mixture of toluene diamines or the crude diphenylmethane diisocyanate obtained by the phosgenation of crude methylene diphenylamine. Useful undistilled or crude polyisocyanates are disclosed in U.S. Pat. No. 3,215,652 which is hereby incorporated by reference for such disclosure. Derivatives of the above identified isocyanates, such as, prepolymers, are equally suitable for use in the present invention. For purposes of this discussion, the above discussed isocyanates will be collectively referred to as reactant material 58, unless otherwise specified.

The second reaction component used to form the translucent polymeric material is preferably a resin. More preferably, the resin is a polyol such as a polyimide, polyether or polyester polyol, mixtures thereof, or the like. For example, one preferred translucent polymeric material is a hybrid polyurea polyurethane, which is the reaction product of an isocyanate as above with such a polyol. An example of such a hybrid polyurea polyurethane is disclosed in U.S. Pat. No. 5,059,634 which is hereby incorporated by reference for such disclosure.

It will be appreciated that any of a number of components which will react to form the translucent polymeric material of the present invention is within the scope of the invention. Therefore, the invention is not necessarily limited to the preferred isocyanates or the resins discussed hereinabove. Furthermore, as is common in the art, additives such as catalysts, extenders or the like may be added to one or both of the reaction components during the reaction injection molding process. According to the present invention, the two reaction components are mixed and injected into a mold according to a method to now be described.

Figure 7:
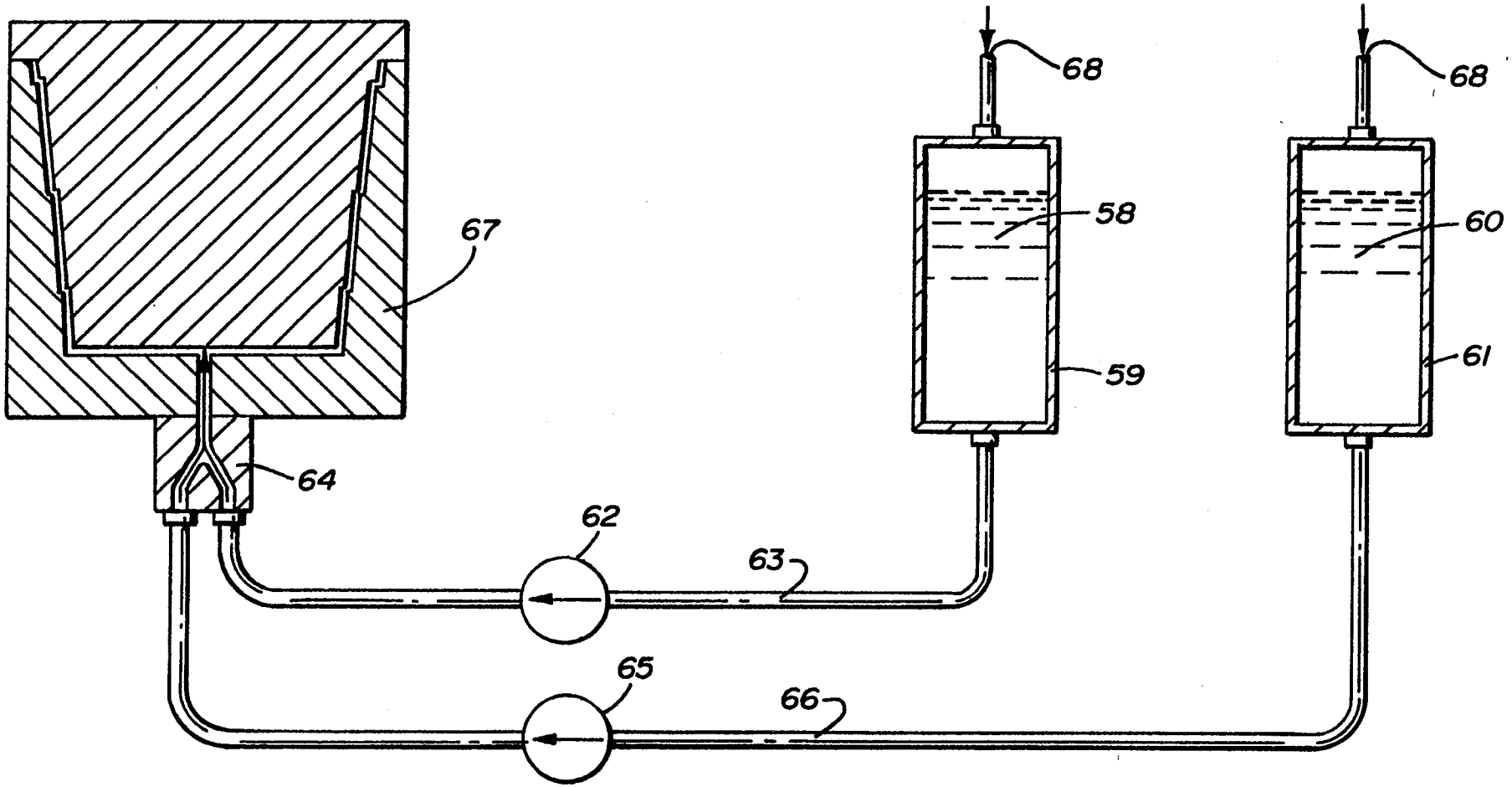
FIG. 7 is a schematic view showing the unique process by which the container of the present invention is manufactured.

The manufacturing process is schematically shown in FIG. 7. A supply of the liquid reactant material 58 may be held in a supply tank 59 and a supply of the liquid resin material 60 may be held in a supply tank 61. As needed, a shot of the reactant 58 is drawn by pump 62 through line 63 to a mixing head 64 and a shot of the resin 60 is drawn by pump 65 through line 66 to mixing head 64 where the two materials are mixed and provided to a mold 67. The normal shot time is approximately twenty-three seconds, with the curing time being approximately one and one-half minutes and the total cycle time being in the range of approximately five to seven minutes.

Under normal similar reaction injection molding processes, air under pressure, for example, approximately forty pounds per square inch, is continuously provided at the top of each tank 59 and 61, as at 68. However, when reacting the materials described above, such could result in an opaque or only partially translucent product because some of the air might be absorbed by the materials thereby changing the properties thereof. Thus, in order to render the molded product translucent, when utilizing the particular resin and reactant materials described above, the air pressure is normally off, such pressure only being applied during the shot time. Thus, in the molding cycle, the air pressure is applied to the top of the materials in tanks 59 and 61 only during the periodic filling of the mold and not while the product is curing. The product thus resulting from this process is a translucent polymeric material. It has been found that it is preferable to maintain tanks 59 and 61 at least fifty percent and preferably about seventy percent full to enhance the translucent nature of the end product.

For shipment and/or storage purposes, containers 10, constructed of a material and configuration as described herein, can be stacked on each other—up to two high when full and up to three high when empty—without damage to the container below. Moreover, as shown in FIG. 6, a container 10 can nest within an almost unlimited number of other like containers. FIG. 6 shows three nested containers, the lower two having their lids removed, and those lids being stacked on the lid of the highest container. It is significant that containers 10 may be nested with a flexible liner 14 therein if desired because an empty liner can be wholly positioned within the nesting space 69 defined by the lower position of lowermost surface 26 of container body 12. Although not shown, containers 10 can also be nested with their base pallet portions 13, such thereby producing only a slightly higher nesting height.

In view of the foregoing, it should thus be appreciated that a container manufactured by the process disclosed herein and having the components and configuration described herein accomplishes the objects of the present invention and otherwise substantially improves the bulk container art.

I claim:

1. A container for holding material comprising a generally rectangular body portion having a bottom surface and sidewalls extending upwardly therefrom to form an upper lip defining an open top; a cover to close said open top; means to attach said cover to said body portion; a base portion having a plurality of spaced feet, sidewalls, and a surface to carry said body portion; said bottom surface of said body portion resting on said surface of said base portion and said sidewalls of said base portion extending above said bottom surface of said body portion to cradle the lower end of said sidewalls of said body portion; and a plastic liner positionable in said body portion; said liner having a reinforced bottom surface of the same profile as said bottom surface of said body portion, a flexible sidewall capable of conforming to said sidewalls of said body portion and extending upwardly from said bottom surface, and a peripheral cuff formed at the top of said sidewall for attachment to said upper lip.

2. A container according to claim 1, said cover having a generally planar surface with an opening therein through which the material may be received by said body portion, and means to close said opening.

3. A container according to claim 2, said cover further including a wall positioned around the periphery of said planar surface and a skirt spaced from said wall, said upper lip of said body portion being received in the space between said wall and said skirt.

4. A container according to claim 3, said cover further including an upper rim connecting said wall to said skirt, and further comprising a gasket between said upper lip of said body portion and said upper rim of said cover.

5. A container according to claim 3 wherein said means to attach includes first aligned apertures through said wall and said skirt of said cover and second apertures through said upper lip of said body portion below the open top, said first and second apertures being alignable to receive means to fasten therethrough.

6. A container according to claim 1 further comprising a recess formed near the bottom of one of said sidewalls of said body portion, and a valve positioned in said recess for discharge of the material from said body portion.

7. A container according to claim 6 further comprising a notch formed in one of said sidewalls of said base portion, said notch being aligned with said recess.

8. A container according to claim 1 wherein said plurality of feet of said base portion include corner feet extending downwardly from said surface of said base portion near the corners thereof, and additional feet spaced between each said corner foot, the spacing between said corner feet and said additional feet forming recesses under said surface to receive the arms of a fork lift truck from any side of the container.

9. A container according to claim 1 wherein said sidewalls of said body portion and said base portion taper outwardly as they extend upwardly from said bottom surface so that a like container may be nested in the container.

10. A container according to claim 1, said sidewalls of said body portion having stepped surfaces, the lowermost of said stepped surfaces being cradled by the sidewalls of said base portion.

11. A container according to claim 1 wherein said body portion is constructed of a rigid, translucent, plastic material.

12. A container for holding material comprising a generally rectangular body portion having a bottom surface and sidewalls extending upwardly therefrom to form an upper lip defining an open top; a cover to close said open top; means to attach said cover to said body portion; a base portion having a plurality of spaced feet, sidewalls, and a surface to carry said body portion; said bottom surface of said body portion resting on said surface of said base portion and said sidewalls of said base portion extending above said bottom surface of said body portion to cradle the lower end of said sidewalls of said body portion; and a flexible plastic liner positionable in said body portion; said liner including a bottom surface, a flexible sidewall capable of conforming to said sidewalls of said body portion and extending upwardly from said bottom surface, and a peripheral cuff formed at the top of said sidewall; said cuff being positioned over said upper lip of said body portion, and said means to attach also engaging said cuff to attach said liner to said cover and said body portion.

13. A container according to claim 12, said liner including a top surface having a neck opening therein through which the material may be received by said liner.

14. A container according to claim 12, said flexible sidewall having a tube formed therein, and further comprising a valve positioned outside of one said sidewall of said body portion, and means to connect said tube to said valve.

15. A container for holding material comprising a generally rectangular body portion having a bottom surface and sidewalls extending upwardly therefrom to form an upper lip defining an open top; a cover to close said open top; means to attach said cover to said body portion; a base portion having a plurality of spaced feet, sidewalls, and a surface to carry said body portion; said bottom surface of said body portion resting on said surface of said base portion and said sidewalls of said base portion extending above said bottom surface of said body portion to cradle the lower end of said sidewalls of said body portion; a flexible plastic liner positonable in said body portion; said liner including a bottom surface, a flexible sidewall capable of conforming to said sidewalls of said body portion and extending upwardly from said bottom surface, and a peripheral cuff formed at the top of said sidewall; said flexible sidewall having a tube formed therein; a valve positioned outside of one said sidewall of said body portion; and means to connect said tube to said valve; said means to connect including a tubular connector receiving said tube and having outer circumferential barbs thereon, and an adaptor tube having internal barbs to engage said barbs of said tubular connector and having a tapered outer surface adapted to be received by said valve.

16. A container for holding material comprising a body portion having a bottom surface and sidewalls extending upwardly therefrom to form an upper lip defining an open top; a cover to close said open top; a flexible plastic liner received in said body portion, said liner having a bottom surface, a flexible sidewall capable of conforming to said sidewalls of said body portion and extending upwardly from said bottom surface, and cuff means near the top of said flexible sidewall and positioned between said upper lip of said body portion and said cover; and means to attach said cover to said body portion with said cuff means therebetween; said cover including a peripheral wall and a skirt spaced from said wall, said upper lip of said body portion being received in the space between said wall and said skirt and said cuff means being positioned between said wall and said upper lip and said skirt and said upper lip.

17. A container according to claim 16 wherein said means to attach includes first aligned apertures through said wall and said skirt of said cover and second apertures through said upper lip of said body portion below the open top, said first and second apertures being alignable to receive means to fasten therethrough.

18. A container according to claim 16 wherein said sidewalls of said body portion taper outwardly as they extend upwardly from said bottom surface so that a like container may be nested within the container, the bottom surface of the like container being spaced from said bottom surface of the container, said liner being wholly positionable in the space between the bottom surface of the like container and said bottom surface of the container.

19. A container according to claim 16 wherein said body portion is constructed of a rigid, translucent, plastic material.

20. A container according to claim 16 further comprising a base portion carrying said body portion, said base portion having sidewalls extending upwardly along and outside of said sidewalls of said body portion to cradle said sidewalls of said body portion.

21. A container according to claim 20, said base portion having a support surface between said sidewalls, said bottom surface of said body portion resting on said support surface.

22. A container according to claim 21 wherein said base portion includes a plurality of spaced feet extending downwardly from said support surface, the spacing between said feet being large enough to accommodate the arms of a fork lift truck.

23. A container for holding material comprising a body portion having a bottom surface and sidewalls extending upwardly therefrom to form an upper lip defining an open top; a cover to close said open top; a flexible plastic liner received in said body portion, said liner having a bottom surface, a flexible sidewall capable of conforming to said sidewalls of said body portion and extending upwardly from said bottom surface, cuff means near the top of said bottom surface, cuff means near the top of said flexible sidewall and positioned between said upper lip of said body portion and said cover, and means to reinforce said bottom surface of said liner, said means to reinforce being of the same profile as said bottom surface of said body portion; and means to attach said cover to said body portion with said cuff means therebetween.

24. A container for holding material comprising a body portion having a bottom surface and sidewalls extending upwardly therefrom to form an upper lip defining an open top; a cover to close said open top; a flexible plastic liner received in said body portion, said liner having a bottom surface, a flexible sidewall capable of conforming to said sidewalls of said body portion and extending upwardly from sad bottom surface, and cuff means near the top of said flexible sidewall and positioned between said upper lip of said body portion and said cover; and means to attach said cover to said body portion with said cuff means therebetween; said cover having a generally planar surface with an opening therein, and said liner having a top surface, said top surface of said liner having a neck opening therein alignable with said opening in said planar surface of said cover so that the material may pass through said cover and into said liner through said neck opening.

25. A container for holding material comprising a body portion having a bottom surface and sidewalls extending upwardly therefrom to form an upper lip defining an open top; a cover to close said open top; a flexible plastic liner received in said body portion, said liner having a bottom surface, a flexible sidewall capable of conforming to said sidewalls of said body portion and extending upwardly from said bottom surface, a tube formed in said flexible sidewall, and cuff means near the top of said flexible sidewall and positioned between said upper lip of said body portion and said cover; means to attach said cover to said body portion with said cuff means therebetween; a valve positioned outside of one said sidewall of said body portion; and means to connect said tube to said valve.

26. A container according to claim 25 wherein said means to connect includes a tubular connector receiving said tube and having outer circumferential barbs thereon, and an adaptor tube having internal barbs to engage said barbs of said tubular connector and having a tapered outer surface adapted to be received by said valve.

27. A container according to claim 25 further comprising a recess formed near the bottom on the outside of one of said sidewalls of said body portion, said valve being positioned in said recess.

28. A plastic bag adapted to hold material and be used as a liner for a container comprising a bottom surface, sidewalls extending upwardly from said bottom surface, a top surface between said sidewalls, an opening in said top surface through which the material may pass, and a peripheral cuff extending outwardly from near the top of said sidewalls and away from said top surface.

29. A plastic bag according to claim 28 further comprising discharge means formed near the bottom of one of said sidewalls so that the material may be removed from the bag.

30. A plastic bag according to claim 28 wherein said bottom surface is reinforced by a rigid material and said sidewalls, said top surface and said cuff are flexible members.

31. A container for holding material and adapted to be nestable within a like container comprising a generally rectangular bottom surface, four sidewalls extending upwardly from the periphery of said bottom surface and tapering outwardly to form an open top defined by an upper lip of a generally rectangular configuration larger than said bottom surface, a base member, said base member including a support surface for said bottom surface and a plurality of feet extending downwardly from said support surface, a recess in one of said sidewalls near the bottom thereof, a valve positioned in said recess for the discharge of the material, a liner having a bottom wall generally corresponding to the configuration of said bottom surface and a sidewall extending upwardly therefrom, said sidewall of said liner taking on the form of and normally being positioned adjacent to said sidewalls of the container so that the material can be received in said liner, and means on said liner to connect said liner to said valve so that the material in said liner may be discharged through said valve, the like container being positionable in the container through said upper lip with the bottom surface of the like container being spaced from said bottom surface, said liner being positionable wholly in the space between the bottom surface of the like container and said base member when like containers are nested.

* * * * *

UNITED STATES PATENT AND TRADEMARK OFFICE

CERTIFICATE OF CORRECTION

PATENT NO. : 5,375,741

DATED : December 27, 1994

INVENTOR(S) : Harris

It is certified that error appears in the above-identified patent and that said Letters Patent is hereby corrected as shown below:

Claim 23, column 10, lines 63-64, delete "cuff means near the top of said bottom surface,".

Claim 24, column 11, line 11, "sad" should be "said".

Signed and Sealed this

Second Day of April, 1996

Bruce Lehman

*Attest:*

BRUCE LEHMAN

*Attesting Officer*

*Commissioner of Patents and Trademarks*